US010294570B2

(12) United States Patent
Jaworowski et al.

(10) Patent No.: US 10,294,570 B2
(45) Date of Patent: May 21, 2019

(54) METHOD FOR MAKING CORROSION RESISTANT COATING

(71) Applicant: Hamilton Sundstrand Corporation, Charlotte, NC (US)

(72) Inventors: Mark R. Jaworowski, Glastonbury, CT (US); Blair A. Smith, South Windsor, CT (US); Georgios S. Zafiris, Glastonbury, CT (US); Weilong Zhang, Glastonbury, CT (US); Michael A. Kryzman, West Hartford, CT (US); Treese Hugener-Campbell, Coventry, CT (US); Bart Antonie van Hassel, Weatogue, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 422 days.

(21) Appl. No.: 15/095,926

(22) Filed: Apr. 11, 2016

(65) Prior Publication Data

US 2017/0292193 A1 Oct. 12, 2017

(51) Int. Cl.

| | |
|---|---|
| ***C23C 8/12*** | (2006.01) |
| ***C23C 22/30*** | (2006.01) |
| ***C23C 22/34*** | (2006.01) |
| ***C23C 22/78*** | (2006.01) |
| ***C23C 22/82*** | (2006.01) |
| ***C23C 22/83*** | (2006.01) |
| *C23C 22/00* | (2006.01) |

(52) U.S. Cl.

CPC ..... *C23C 22/34* (2013.01); *C23C 22/78* (2013.01); *C23C 22/82* (2013.01); *C23C 22/83* (2013.01); *C23C 2222/10* (2013.01)

(58) Field of Classification Search

CPC ..... C23C 2222/10; C23C 22/34; C23C 22/78; C23C 22/82–22/83; C23C 8/12

See application file for complete search history.

(56) References Cited

U.S. PATENT DOCUMENTS

| | | | | |
|---|---|---|---|---|
| 5,304,257 | A | 4/1994 | Pearlstein et al. | |
| 2007/0187001 | A1 | 8/2007 | Kramer et al. | |
| 2010/0132843 | A1* | 6/2010 | Kramer | C23C 22/34 148/247 |
| 2011/0300406 | A1* | 12/2011 | Dees | C09D 1/00 428/651 |
| 2015/0354085 | A1 | 12/2015 | Bokisa | |

FOREIGN PATENT DOCUMENTS

| | | | |
|---|---|---|---|
| WO | WO2007134152 | A1 | 11/2007 |
| WO | WO2009007208 | A1 | 1/2009 |

OTHER PUBLICATIONS

Extended European Search Report for EP Application No. 17161792.1, dated Aug. 8, 2017, 6 Pages.

H. Bhatt, "Trivalent Chromium Conversion Coating for Corrosion Protection of Aluminum Surface", from 2009 DoD Corrosion Conference, pp. 1-12.

* cited by examiner

*Primary Examiner* — Lois L Zheng

(74) *Attorney, Agent, or Firm* — Kinney & Lange, P.A.

(57) ABSTRACT

A method for making an environmentally-safe chromium based corrosion resistant coating includes pre-treating a metal substrate, immersing the metal substrate in a trivalent chromium bath which does not contain hexavalent chromium, post-treating the coated metal substrate with an oxidizer, and curing the coated metal substrate in a controlled environment.

7 Claims, 5 Drawing Sheets

METHOD FOR MAKING CORROSION RESISTANT COATING

BACKGROUND

Chromium based conversion coatings are used to passivate metals such as aluminum, copper, cadmium, zinc, magnesium, tin, silver, iron, and their alloys to reduce and slow corrosion of the metal, or as a finishing coating. Chromium conversion coatings can be applied to everyday items such as tools or hardware to prevent corrosion, and to aerospace and commercial equipment with high requirements for corrosion durability.

Traditionally, chromic acid was used to create conversion coating. However, chromic acid contains high levels of hexavalent chromium. Hexavalent chromium was used to create conversion coatings due to its high oxidation state, resulting in highly effective anti-corrosion coatings. Specifically, hexavalent chromium based conversion coatings prevent oxide formation on the surface of the metal, are conductive, thin and flexible, provide adhesion for other coatings such as adhesives, paints, sealants, and substantially slow corrosion.

However, hexavalent chromium is now known to be a dangerous toxin and a known carcinogen. Chronic inhalation of hexavalent chromium increases risk of lung cancer among other health complications. The presence of hexavalent chromium in drinking water has created substantial health risk as well. For this reason, hexavalent chromium is heavily regulated in both the U.S. and abroad. In 2017, the EU will ban hexavalent chromium for many applications unless an authorization for a specific application or use has been granted.

Corrosion resistance of a conversion coating is a function of the amount of hexavalent chromium on the surface of the coating. Thus, industry has been actively trying to find a substitute for hexavalent chromium based conversion coatings. No alternatives to hexavalent chromium coatings have exhibited as high a corrosion resistance. Specifically, many inventors have tried to use non-toxic trivalent chromium solutions to passivate metals and create corrosion resistant coatings. In these methods, trivalent chromium solutions are used during processing rather than hexavalent chromium solutions. The suggested methods, such as that disclosed in U.S. Pat. No. 5,304,257 to Pearlstein et al. ("Pearlstein"), do not create corrosion coatings that are as effective as the previous hexavalent chromium based coatings.

Pearlstein discloses a method of making a coating which uses an immersion bath of aqueous trivalent chromium to coat an aluminum substrate. After the substrate is removed from the bath, the coating is exposed to an oxidizing solution such that a small portion of the trivalent chromium is converted to hexavalent chromium. However, the method disclosed in Pearlstein contaminates the oxidizing solution and any subsequent rinse waters with hexavalent chromium, creating a chemical waste stream and a chemical exposure hazard.

SUMMARY

A method of producing a corrosion resistant coating includes pre-treating a metal substrate such that a surface of the metal substrate is de-oxidized; immersing the metal substrate in a coating solution to produce a chromium based coating on the metal substrate, wherein the coating solution consists of a trivalent chromium compound, and a fluoride compound, but not containing hexavalent chromium; removing the coated metal substrate from the coating solution; and curing the chromium based coating in a controlled environment containing a gaseous atmosphere to produce a hexavalent chromium enriched corrosion resistant coating on the metal substrate.

DETAILED DESCRIPTION

The present invention discloses a method for making a corrosion resistant coating using non-toxic trivalent chromium during processing. Trivalent chromium conversion coatings, once applied to a metal substrate, include varying amounts of naturally occurring hexavalent chromium compounds in the coating. The relative amount of hexavalent chromium to trivalent chromium in conversion coatings varies systemically with types of pre-treatment, processing conditions, and post-treatment. The relative amount of hexavalent chromium to trivalent chromium correlates strongly with corrosion resistance, as hexavalent chromium compounds are corrosion inhibitors.

Thus, when the trivalent chromium based coating is cured under a certain set of conditions, the oxidation state of trivalent chromium will change to hexavalent chromium, increasing the corrosion resistant properties of the coating without utilizing hexavalent chromium during processing. Specifically, the coating is cured in an environment where relative humidity, temperature, atmosphere and other variables can be controlled. The controlled curing allows for optimization of hexavalent chromium on the surface of the metal substrate, and higher corrosion resistance, without the toxin impact of using hexavalent chromium solutions.

Figure 1:
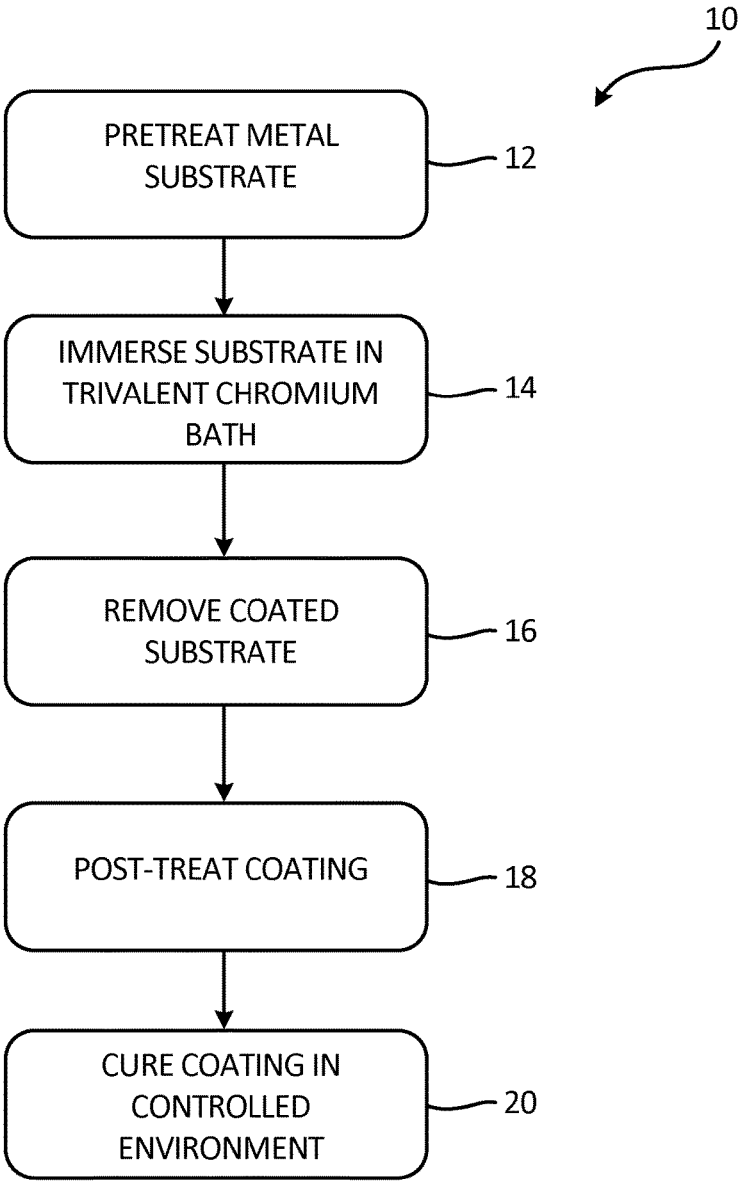
FIG. 1 is a flow chart depicting a method of producing a corrosion resistant coating.

FIG. 1 depicts method 10 of making a trivalent chromium based corrosion resistant coating. Method 10 includes pre-treating a metal substrate (step 12), immersing the metal substrate in a solution including trivalent chromium but not including hexavalent chromium (step 14), removing the coated metal substrate from the solution (step 16), post-treating the coated metal substrate with an oxidizer (step 18), and curing the metal substrate in a controlled environment to produce a hexavalent chromium enriched, corrosion resistant coating on the metal substrate (step 20).

First, the metal substrate is pre-treated (step 12). The metal substrate may be aluminum, zinc, cadmium, copper, silver, magnesium, tin, iron, or alloys of those metals, such as aluminum based alloys, zinc based alloys, cadmium based alloys, copper based alloys, silver based alloys, magnesium based alloys, tin based alloys, or iron based alloys. The pre-treatment may be chemical or mechanical. A chemical pre-treatment can include degreasing with an alkaline degreaser or with a different solvent, such as acetone or isopropanol, rinsing with water, and using an acid cleaner, such as nitric acid, to de-oxidize the surface of the metal substrate. In contrast, a mechanical pre-treatment can include grit-blasting, sanding, pumice scrubbing, or abrasive pad processing of the metal substrate, and subsequently degreasing the metal substrate in acetone, a different solvent, or a different degreaser.

After the metal substrate is pre-treated, it is immersed in a trivalent chromium rich bath (step 14). The bath is a solution containing a trivalent chromium salt, such as chromium sulfate, a fluoride compound, such as an alkali metal fluorosilicate, and a sufficient amount of alkali to maintain the solution pH. Various trivalent chromium process (TCP) solutions are readily available.

During the bath, a trivalent chromium coating adheres to the metal substrate. When the coating is formed on the metal substrate, it is initially in the form of a hydrated gel on the surface of the metal substrate. While still in the bath, the hydrated gel is surrounded by the solution. The hydrated gel is permeable to oxygen and fluoride ions from the solution. These molecules remove a native oxide layer from the metal substrate to allow formation of the chromium based coating on the surface of the metal substrate, and allow for oxidation of trivalent chromium on the surface to corrosion resistant hexavalent chromium.

When the chromium coating is formed, a small amount trivalent chromium is naturally converted to hexavalent chromium. The oxidation of trivalent chromium to hexavalent chromium occurs as hydrogen peroxide is generated from the interaction of the metal substrate with the TCP solution. Specifically, the metal substrate undergoes oxidation and produces electrons. If the substrate is aluminum, the aluminum is oxidized, forming an inner alumina film that stretches across the aluminum surface, as shown in Equation 1:

$$2Al+3H_2O \rightarrow Al_2O_3+6H^+6e \qquad \text{Equation 1}$$

The alumina film dissolves through a reaction with hydrofluoric acid. At the same time, in a water-rich environment, such as the aqueous bath in this coating method, the electrons produced through metal dissolution generate hydrogen peroxide, as shown in Equation 2:

$$O_2+2H_2O+2e^- \rightarrow H_2O_2+2OH^- \qquad \text{Equation 2}$$

The production of hydrogen peroxide on the surface of the metal substrate allows for an oxidizing environment which oxidizes some of the trivalent chromium on the surface to hexavalent chromium, as shown in Equation 3:

$$2Cr(OH)_3+3H_2O_2 \rightarrow 2Cr(OH)_6 \qquad \text{Equation 3}$$

Two other chemical reactions compete with the hydrogen peroxide-producing reaction: the reduction of oxygen to hydroxyl ions (pictured in Equation 2), and the evolution of hydrogen gas from hydrogen ions, as shown in Equation 4 below.

$$2H^++2e^- \rightarrow H_2 \qquad \text{Equation 4}$$

Even though some hexavalent chromium is formed on the surface of the metal substrate as it is exposed to the trivalent chromium bath, there is still a high ratio of trivalent chromium on the surface of the metal substrate when it is removed from the bath (step 16).

After the coated metal substrate is removed from the bath, the coating is post-treated with an oxidizer, such as hydrogen peroxide (step 18). This post-treatment increases the oxidation environment on the coating, and induces further oxidation of trivalent chromium to hexavalent chromium (as shown in Equation 3), and increases corrosion resistance of the coating. The hydrogen peroxide solution can be 0.3 wt % to 3.5 wt %. The post-treatment further oxidizes trivalent chromium on the surface of the coating to increase the amount of hexavalent chromium on the surface of the coating before it is placed in the controlled environment for curing. Raman spectral data shows samples treated with hydrogen peroxide at this stage have a higher ratio of hexavalent chromium to total chromium on the surface of the coating, as shown in Table 1. The ratio of hexavalent chromium to total chromium content given here is not an actual concentration, but is a relative proportion estimated from detected Raman spectra peak heights, where hexavalent chromium is obtained from a peak height of 880 $cm^{-1}$ and a mixture of hexavalent chromium and trivalent chromium is obtained from 860 $cm^{-1}$. The peak assigned for trivalent chromium is measured at 535 $cm^{-1}$.

TABLE 1

| Post-Treatment | None | 0.3 wt % $H_2O_2$ |
|---|---|---|
| Average Ratio of $Cr^{6+}/[Cr^{6+} + Cr^{3+}]$ | 0.38 | 0.51 |

Finally, the coated metal substrate is cured in a controlled environment (step 20). In the controlled environment, atmosphere, temperature, relative humidity, curing gas, and exposure to oxidizer is controlled. Each of these variables can enrich the hexavalent chromium on the surface of the chromium conversion coating by creating an environment favorable to oxidation of the trivalent chromium, and consequently increase the corrosion resistance of the coating. The coatings resulting from these conditions were analyzed using Raman spectroscopy to show the presence of hexavalent chromium, trivalent chromium, and total chromium was on the surface of the conversion coatings (Table 2). In these tests, the temperature of the controlled environment was kept consistent at 22° C. to 24° C.

The atmosphere in the controlled environment may be air, oxygen, nitrogen, argon, other inert or oxidizing gases, or some combination of those gases. When tested, the use of air containing oxygen resulted in a higher ratio of hexavalent chromium to total chromium content on the surface of the conversion coating. Test data shows the effect of curing gas environment on the relative amount of hexavalent chromium on the surface of the coating, as shown in Table 2:

TABLE 2

| Curing Atmosphere | Ar | Air |
|---|---|---|
| Average Ratio of $Cr^{6+}/[Cr^{6+} + Cr^{3+}]$ | 0.42 | 0.45 |

Relative humidity of the controlled curing environment can also significantly alter the amount of hexavalent chromium on the surface of the conversion coating. When relative humidity is increased, the coating environment contains a higher concentration of water, which naturally induces the production of hydrogen peroxide, as discussed above, and allows for oxidation of the trivalent chromium. When tested, relative humidity of <20% was ineffective at curing a conversion coating such that a high ratio of hexavalent chromium formed. Relative humidity 50% or higher produced the best results. Relative humidity of <20%, which induced rapid drying, induces cracks in the coating, which minimize corrosion protection. This is summarized in Table 3, where the relative amount of surface hexavalent chromium was determined from both Cr(VI) and Cr(III) characteristic peak heights in area around 860 cm−1 and 535 cm−1, individually using Raman spectroscopy:

TABLE 3

| Relative Humidity | <20% | ~50% | >90% |
|---|---|---|---|
| Average Ratio of $Cr^{6+}/[Cr^{6+} + Cr^{3+}]$ | 0.41 | 0.56 | 0.44 |

The controlled environment can be altered to be an oxidizing environment through the use of irradiation with ultra-violet light, or through the injection of an oxidizing, non-corrosive gas, such as ozone. If UV is used, the preferred UV integrated flux is 360 kJ/$m^2$, but metal substrates with favorable geometries, such as flat surfaces, many require less, while metal substrates with complex geometries may require diffuse exposure with greater nominal flux. UV wavelengths in the UV-A class, of 315-400 nm, is preferred due to safety concerns; but UV-B and UV-C wavelengths can be used to the same effect. The exposure of the coating to UV radiation will induce further oxidation of trivalent chromium to hexavalent chromium, creating a more corrosion resistant coating.

The coating can alternatively be exposed to ozone to oxidize the trivalent chromium in the coating to hexavalent chromium. In this case, the preferred ozone exposure is 1 ppm $O_3$ for one hour. Alternatively, for safety reasons, the controlled environment can be exposed to 0.1 ppm $O_3$ for anywhere between four and twenty-four hours. Preferably, ozone exposure is conducted when the environment has over 50% relative humidity. Ozone, a strong oxidizer, also induces the oxidation of trivalent chromium to hexavalent chromium.

Finally, shorter curing times in the controlled environment produced more hexavalent chromium-rich coatings (Table 4). Curing the coatings for a time between one hour and one day produced the most corrosion resistant coatings, while curing the coatings for one week long (168 hrs) did not.

TABLE 4

| Cure Time | 1 Hour | 24 Hours | 168 Hours |
|---|---|---|---|
| Average Ratio of $Cr^{6+}/[Cr^{6+} + Cr^{3+}]$ | 0.49 | 0.43 | 0.43 |

Figure 2:
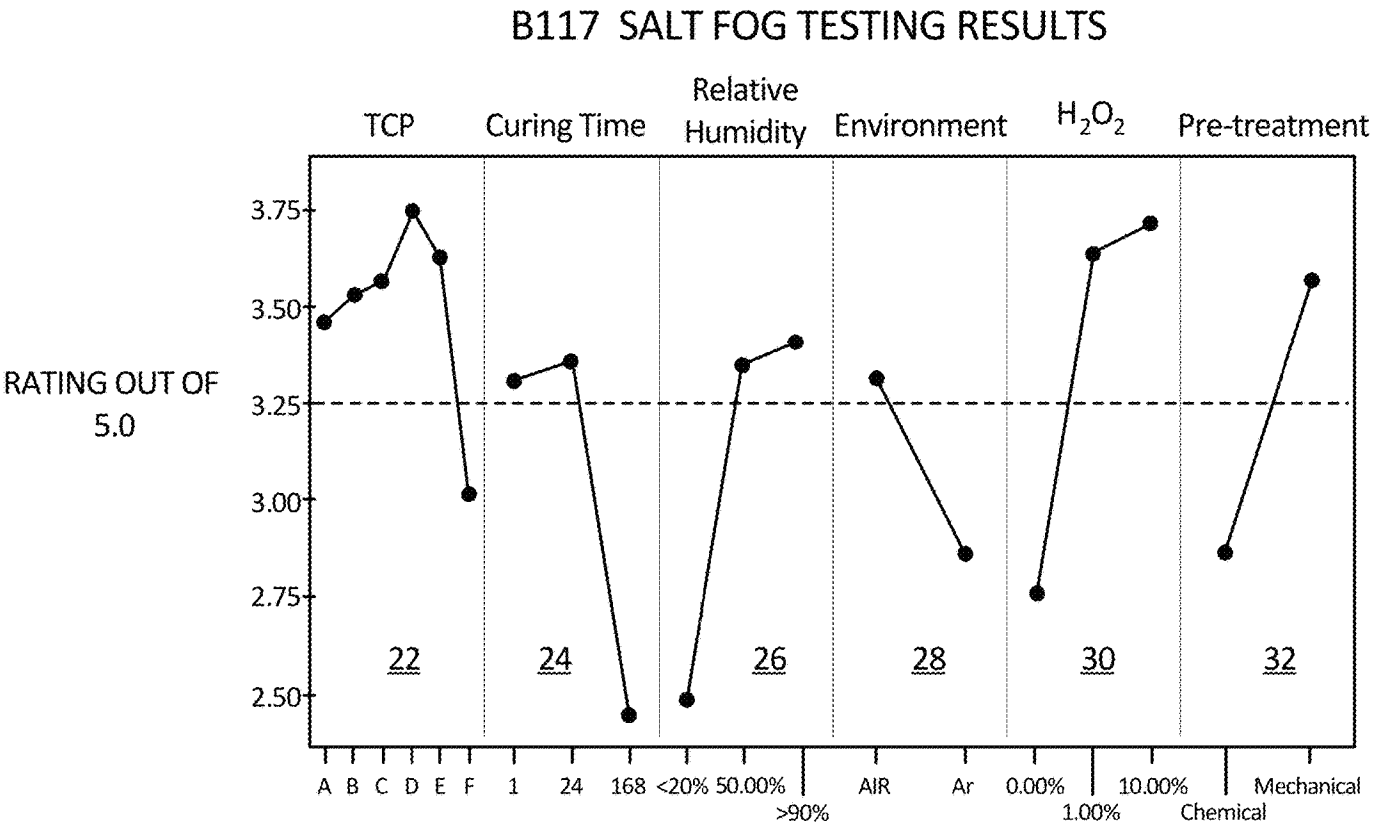
FIG. 2 is a graph depicting the corrosion resistance rating of coatings as a function of varying processing and curing conditions.

FIG. 2 is a series of graphs summarizing the ASTM B117 salt-fog test corrosion performance results of varying curing conditions, such as the type of trivalent chromium bath vendor and chemistry (graph 22), curing time (graph 24), relative humidity (graph 26), curing atmosphere (graph 28), hydrogen peroxide post-treatment (graph 30), and surface pre-treatments (graph 32). In each set of tests, the other variables were held constant. After curing, each sample set was ASTM B117 neutral salt-fog tested for corrosion resistance. ASTM B117 neutral salt-fog testing is an industry-known method of testing the corrosion resistance of surface coatings. With this method, ASTM B117 neutral salt fog testing was completed on test panels of coatings cured under different conditions. The samples were then analyzed for corrosion resistance and rated on a scale from 0.00 to 5.00, where 5.00 is an ideal corrosion resistance coating, with no pits. Thus, a coating with a 5.00 rating exhibited high corrosion resistance, a large ratio of hexavalent chromium to total chromium, and good surface morphology with no pits.

Graph 22 shows the use of six types of commercially available trivalent chromium processes ("TCP"): "A", "B", "C", "D", "E", and "F". The effects of different TCP was unpredictable, as some trivalent bath solutions resulted in a better corrosion resistance rating, and others did not. Specifically, TCP solutions D and E performed the best, resulting in ASTM B117 salt-fog test ratings of 3.75 and 3.63 on average, while TCP solution F produced the lowest rating during salt-spray testing, only 3.01 on average.

Graph 24 shows the salt-spray corrosion rating as a function of curing time. If the sample was cured between one hour and twenty-four hours, and then removed from the controlled environment, the rating averaged between about 3.31 and 3.36 out of 5.00. At curing time greater than twenty-four hours the rating dropped, for example down to 2.44 or lower after 168 hours of curing. Thus, shorter curing times resulted in better corrosion resistance.

Graph 26 shows the effect of relative humidity in the controlled curing environment on the corrosion resistance of the coating. The samples with the best corrosion resistance were cured in an environment containing at least 50% relative humidity. Samples cured in atmospheres with 90% or greater relative humidity also produced good corrosion resistance, with a rating of up to 3.41. The amount of water in the curing environment continuously drives the metal oxidation and oxygen reduction reactions (shown in equations 1 and 2 above), resulting in hydrogen peroxide on the surface of the coating which oxidizes trivalent chromium to hexavalent chromium, increasing the ratio of hexavalent chromium to total chromium, thus increasing corrosion resistance.

Graph 28 depicts the effect of a curing atmosphere that is inert as opposed to a curing atmosphere which consists of air. When argon was used as the inert curing environment, the average corrosion resistance rating was lower than when air was used. When air was used, the oxygen present in air may drive the oxygen reduction reaction shown in Equation 2 above, producing hydrogen peroxide which may oxidize trivalent chromium to hexavalent chromium, and increase the corrosion resistance of the coating. Samples cured in air had a rating of 3.31 on average.

Graph 30 depicts the difference between samples post-treated with hydrogen peroxide after the trivalent chromium bath and those not post-treated with hydrogen peroxide. Samples not post-treated with an oxidizer had an average corrosion resistance rating below 3.00, whereas those samples treated with hydrogen peroxide post-bath contained a rating of 3.64 or higher on average, up to 3.75. The post-treatment with hydrogen peroxide drives the oxidation of trivalent chromium as shown in Equation 3.

Finally, graph 32 shows the difference in corrosion resistance rating of samples pre-treated (step 12 of FIG. 1) with mechanical means as opposed to chemical means. The pre-treatment process (step 12 of FIG. 1) cleans the surface of the metal substrate to allow for formation of the corrosion resistant coating. When a mechanical pre-treatment was used, the corrosion resistance rating was higher, up to 3.57 on average, than when a chemical pre-treatment was used.

Figure 3:
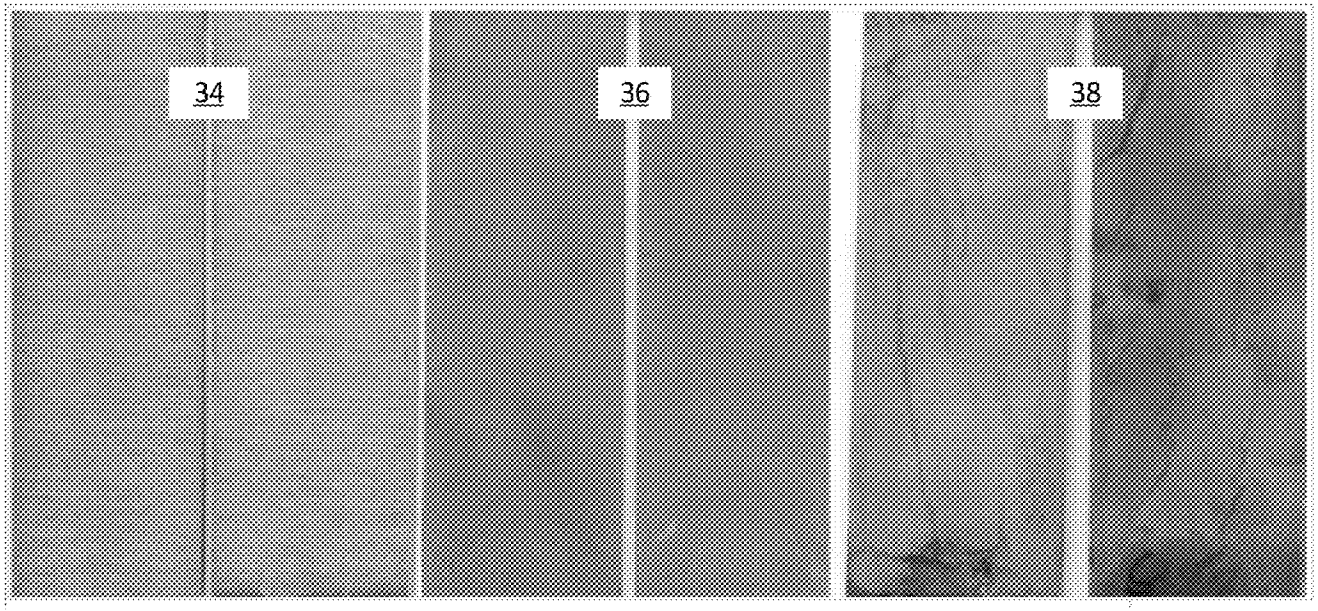
FIG. 3 is a series of photographs showing the morphology of chromium based corrosion resistant coatings processed and cured under different conditions.

FIG. 3 depicts photographs of several corrosion resistant coating created under different conditions. Each photograph 34, 36, 38, shows two 3 inch by 5 inch metal test panels which were coated according to the method in FIG. 1, but each sample 34, 36, 38 was cured under different conditions. Each test panel was then tested for corrosion resistance with salt fog testing, as discussed above. The samples were analyzed for corrosion resistance and rated on a scale from 0.0 to 5.0, where 5.0 is an ideal corrosion resistance coating. A coating with a 5.0 rating exhibited high corrosion resistance, a large ratio of hexavalent chromium to total chromium, and good morphology.

Photograph 34 shows a corrosion resistant coating processed under conditions that included a mechanical pre-treatment, a 0.3 wt % hydrogen-peroxide post-treatment, and curing for a short time in a controlled environment containing air at a relative humidity of around 50%. The morphology of the samples in photograph 34 is smooth and lighter in color with no discernable pits.

In contrast, photograph 36 shows a corrosion resistant coating processed under the same conditions, but without the hydrogen-peroxide post-treatment. The morphology of the samples in photograph 36 is also smooth, but it is darker in color, indicating the early stages of coating failure and aluminum substrate pitting compared to the sample treated with hydrogen peroxide after the TCP bath.

Finally, photograph 38 shows non-ideal processing where the curing method of the coating is not controlled. Instead, the samples were removed from the TCP and left to dry without any post-treatment or controlled environment. The corrosion in the coating and aluminum substrate corrosion is visible as compared to the other samples.

Figure 4A:
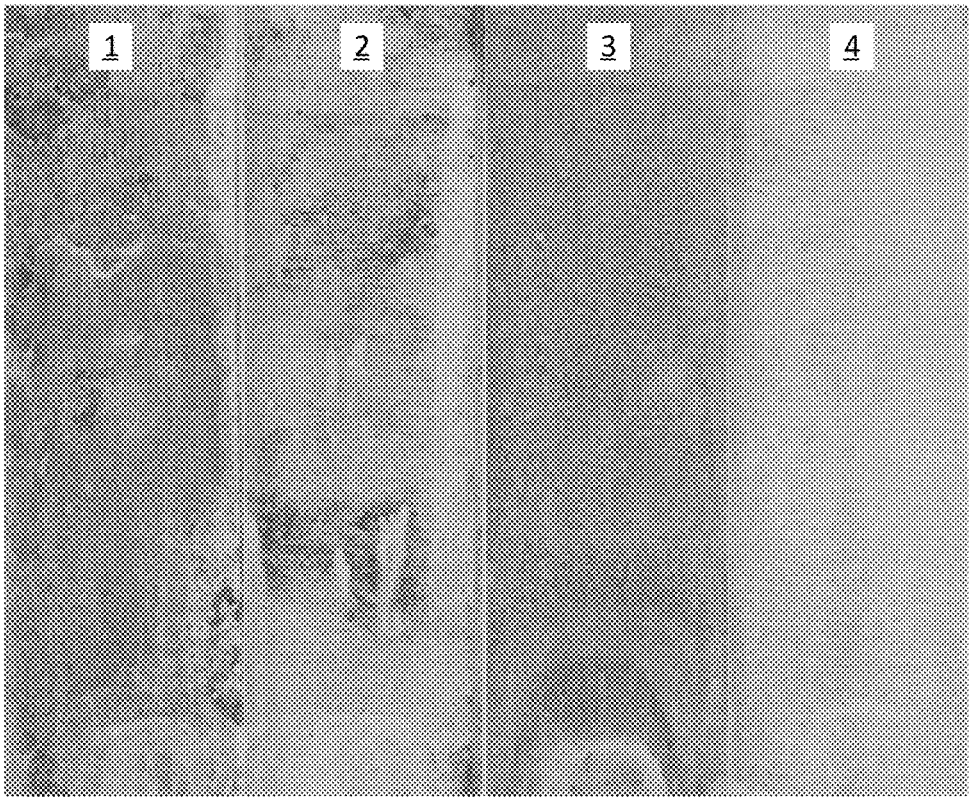
FIG. 4A is a second series of photographs showing the morphology of chromium based corrosion resistant coatings processed and cured under different conditions as described in Table 5.
Figure 4B:
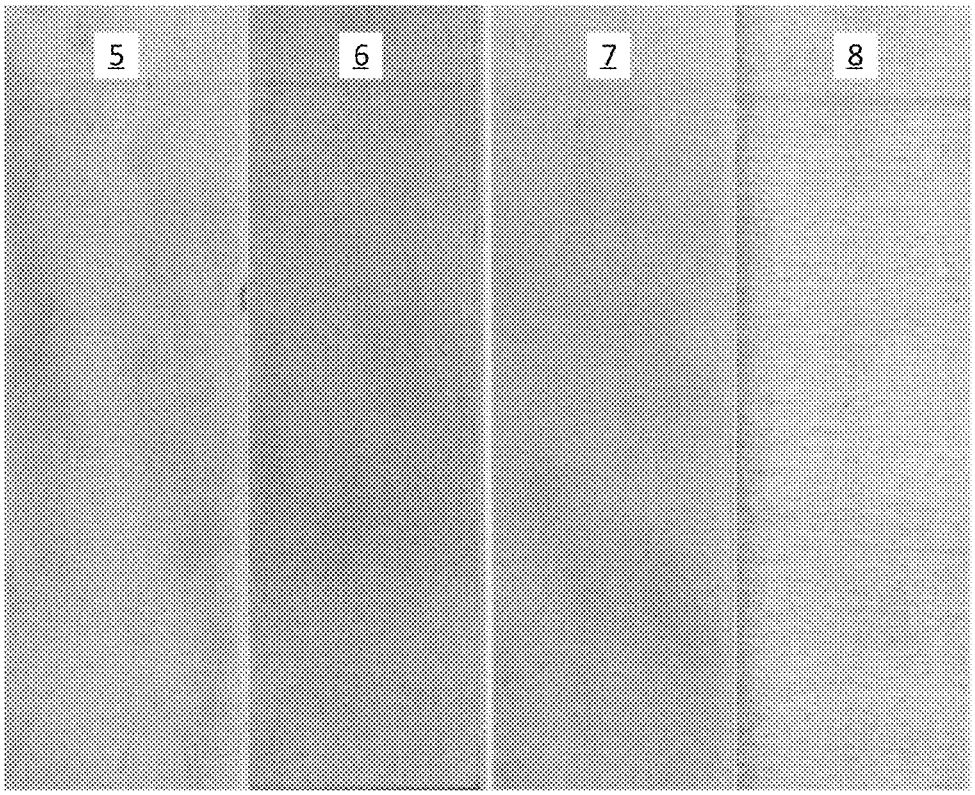
FIG. 4B is a third series of photographs showing the morphology of chromium based corrosion resistant coatings processed and cured under different conditions as described in Table 5.

FIGS. 4A and 4B show another set of 3" by 5" sample coatings, similar to those exhibited in FIG. 3. The testing completed on various samples showed that samples post-treated with hydrogen peroxide, and cured in environments with a relative humidity of >90% obtained the best corrosion-resistance performance in salt fog testing. The results of select samples are summarized in Table 5 below:

TABLE 5

| | Curing time (hr) | Relative Humidity | Curing Gas | Post-treatment | Pre-treatment | Rating at 168 hr | Rating at 336 hr | Cr(6+)/[Cr(3+) + Cr(6+)] | Morphology |
|---|---|---|---|---|---|---|---|---|---|
| 1 | 24 | <20% | Ar | None | Chemical | 1.0 | 1.0 | 0.09 | Corrosion + lots of pits |
| 2 | 168 | <20% | Ar | None | Chemical | 2.5 | 1.0 | 0.15 | Corrosion + lots of pits |
| 3 | 24 | >90% | Air | None | Chemical | 3.5 | 2.5 | 0.33 | About 20 pits |
| 4 | 168 | >90% | Air | None | Chemical | 3.0 | 2.0 | 0.38 | Greater than 20 pits |
| 5 | 24 | >90% | Air | None | Mechanical | 4.3 | 3.8 | 0.70 | 1~2pit |
| 6 | 24 | >90% | Air | 0.3 wt % $H_2O_2$ | Mechanical | 4.5 | 4.5 | 0.70 | No pits |
| 7 | 24 | 50% | Air | 0.3 wt % $H_2O_2$ | Mechanical | 4.3 | 4.3 | 0.73 | No pits |
| 8 | 1 | 50% | Air | 3.5 wt % $H_2O_2$ | Chemical | 5.0 | 4.5 | 0.92 | No pits |

Sample 1 was pre-treated with a chemical agent, was not post-treated with an oxidizer, and was cured for 24 hours in a controlled environment of argon with less than 20% relative humidity. Sample 1 showed both a low ratio of hexavalent chromium to total chromium of only 0.09, and a poor salt fog testing performance rating of 1.0. The photograph of sample 1 in FIG. 4 shows cracking, apparent corrosion and pitting on the surface of the coating.

Similarly, sample 2 was pre-treated with a chemical agent, was not post-treated with an oxidizer, and was cured for 168 hours in a controlled environment of argon with less than 20% relative humidity. Sample 2 showed both a low ratio of hexavalent chromium to total chromium of only 0.15, and a poor salt fog testing performance rating of 2.5 initially, which dropped to 1.0 after 336 hours of exposure to the outside environment. The photograph of sample 2 in FIG. 4 shows cracking, apparent corrosion and pitting on the surface of the coating.

Samples 3 and 4 were pre-treated with a chemical agent, were not post-treated with an oxidizer, but were cured in an environment of air with greater than 90% relative humidity. Sample 3 was cured for 24 hours in this environment, while sample 4 was cured for 168 hours. The ratio of hexavalent chromium to total chromium of the sample has increased compared to samples 1 and 2 due to the increased humidity and air in the controlled environment; sample 3 showed a ratio of 0.33 and sample 4 showed a ratio of 0.38. Additionally, the salt fog performance testing ratings of samples 3 and 4 were 3.5 and 3.0, respectively, but dropped to 2.5 and 2.0 after 336 hours of exposure to the outside environment. Although these samples fared better than samples 1 and 2, they still showed pitting on the surface of the coating, with more than 20 pits in each sample, as shown in FIG. 4A. Thus, increased relative humidity and air in the controlled curing environment are beneficial, but do not alone produce the optimal results.

Similarly, sample 5 was not post-treated with an oxidizer, but was cured in an environment of air with greater than 90% relative humidity for 24 hours. Sample 5 was mechanically pretreated. The controlled relative humidity environment produced samples which had some pitting on the surface, and salt fog testing ratings of about 4.3 after removal from the environment.

In contrast, samples 6, 7 and 8, which were cured in increased relative humidity and a curing environment consisting of air, were also post-treated with an oxidizer conducted before placing the coatings in the curing environment. Samples 6 and 7 were post-treated with 0.3 wt % $H_2O_2$, while sample 8 was post-treated with 3.5 wt % $H_2O_2$. All three samples produced coatings without any visible corrosion, cracking or pits on the surface. Moreover, samples 6, 7, and 8, respectively, produced salt fog test ratings of 4.5, 4.3 and 5.0. The amount of hexavalent chromium on the surface of each sample, respectively, was 0.70, 0.73 and 0.92. The samples treated with hydrogen peroxide before being cured produced the best corrosion resistant coatings.

Overall, curing in a controlled environment of air at a relative humidity of above 20%, followed by hydrogen peroxide post-treatment and exposure to ozone or ultraviolet radiation were the most successful at producing hexavalent rich corrosion resistant conversion coatings that withstood salt fog chamber testing.

Discussion of Possible Embodiments

The following are non-exclusive descriptions of possible embodiments of the present invention.

A method of producing a corrosion resistant coating includes pre-treating a metal substrate such that a surface of the metal substrate is de-oxidized; immersing the metal substrate in a coating solution to produce a chromium based coating on the metal substrate, wherein the coating solution consists of a trivalent chromium compound, and a fluoride compound, but not containing hexavalent chromium; removing the coated metal substrate from the solution; and curing the chromium based coating in a controlled environment containing a gaseous atmosphere to produce a hexavalent chromium enriched corrosion resistant coating on the metal substrate.

The method of the preceding paragraph can optionally include, additionally and/or alternatively, any one or more of the following features, configurations and/or additional components:

The method includes controlling relative humidity within the controlled environment.

The temperature of the controlled environment is between 5° C. and 60° C.

The temperature of the controlled environment is between 15° C. and 30° C.

The metal substrate is selected from the group consisting of aluminum, zinc, cadmium, copper, silver, magnesium, tin, iron, aluminum based alloys, zinc based alloys, cadmium based alloys, copper based alloys, silver based alloys, magnesium based alloys, tin based alloys, and iron alloys.

The metal substrate is pre-treated with a chemical de-oxidizer.

The metal substrate is pre-treated through a mechanical method.

The method includes degreasing the metal substrate prior to immersing the metal substrate in a solution.

The method includes post-treating the coated metal substrate with an oxidizer after removing the coated metal substrate from the coating solution, but before curing the coating.

The metal substrate is post-treated with 0.3 wt % to 3.5 wt % hydrogen peroxide solution.

The gaseous atmosphere has a relative humidity of at least twenty percent.

The gaseous atmosphere has a relative humidity of twenty to fifty percent.

The gaseous atmosphere has a relative humidity of fifty to ninety percent.

The gaseous atmosphere has a relative humidity of more than ninety percent.

The method includes exposing the coated metal substrate in the controlled environment to ozone.

The method includes exposing the coated metal substrate in the controlled environment to ultra-violet radiation.

The coated metal substrate remains in the controlled environment for at least an hour.

The coated metal substrate remains in the controlled environment for at least twenty-four hours.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method comprising:

pre-treating a metal substrate such that a surface of the metal substrate is de-oxidized;

immersing the metal substrate in a coating solution to produce a chromium based coating on the metal substrate, wherein the coating solution comprises a trivalent chromium compound and a fluoride compound, but does not contain hexavalent chromium;

removing the coated metal substrate from the coating solution;

curing the chromium based coating in a controlled environment containing a gaseous atmosphere to produce a hexavalent chromium enriched corrosion resistant coating on the metal substrate;

post-treating the coated metal substrate with an oxidizer after removing the coated metal substrate from the coating solution, but before curing the coating; and exposing the coated metal substrate to ozone in the controlled environment.

2. The method of claim 1, wherein exposing the coated metal substrate to ozone in the controlled environment comprises exposing the coated metal substrate to 1 ppm ozone for one hour.

3. The method of claim 1, wherein exposing the coated metal substrate to ozone in the controlled environment comprises exposing the coated metal substrate to 0.1 ppm ozone for between four and twenty-four hours.

4. The method of claim 1, wherein the gaseous atmosphere has a relative humidity of over fifty percent.

5. The method of claim 1, wherein the metal substrate is post-treated with 0.3 wt % to 3.5 wt % hydrogen peroxide solution.

6. The method of claim 5, wherein the metal substrate is post-treated with 1.0 wt % to 2.5 wt % hydrogen peroxide solution.

7. A method comprising:

pre-treating a metal substrate such that a surface of the metal substrate is de-oxidized;

immersing the metal substrate in a coating solution to produce a chromium based coating on the metal substrate, wherein the coating solution comprises a trivalent chromium compound and a fluoride compound, but does not contain hexavalent chromium;

removing the coated metal substrate from the coating solution;

curing the chromium based coating in a controlled environment containing a gaseous atmosphere to produce a hexavalent chromium enriched corrosion resistant coating on the metal substrate, wherein the gaseous atmosphere has a relative humidity of over fifty percent;

post-treating the coated metal substrate with an oxidizer after removing the coated metal substrate from the coating solution, but before curing the coating, wherein the metal substrate is post-treated with 0.3 wt % to 3.5 wt % hydrogen peroxide solution; and exposing the coated metal substrate to ozone in the controlled environment.

* * * * *